US007629602B2

(12) United States Patent
Kinnemann et al.

(10) Patent No.: US 7,629,602 B2
(45) Date of Patent: Dec. 8, 2009

(54) APPARATUS AND METHOD FOR DETECTING OVERLAPPING FLAT OBJECTS WITH A DOUBLES DETECTOR AND ELECTRONIC IMAGES OF FIRST AND SECOND FLAT SIDES OF AN OBJECT

(75) Inventors: Georg Kinnemann, Bestensee (DE); Svetlozar Delianski, Berlin (DE); Andre Rompe, Berlin Kaulsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/082,101

(22) Filed: Apr. 8, 2008

(65) Prior Publication Data

US 2009/0121163 A1 May 14, 2009

Related U.S. Application Data

(63) Continuation-in-part of application No. PCT/EP2006/007476, filed on Jul. 28, 2006.

(30) Foreign Application Priority Data

Oct. 12, 2005 (DE) ..... 10 2005 049 558

(51) Int. Cl.
*G01N 21/86* (2006.01)

(52) U.S. Cl. ..... 250/559.4; 250/221

(58) Field of Classification Search ..... 250/559.4, 250/559.36, 559.44, 559.46, 221; 399/367, 399/372, 389, 392; 377/8, 11
See application file for complete search history.

(56) References Cited

U.S. PATENT DOCUMENTS 5,534,690 A 7/1996 Goldenberg et al.

(Continued)

FOREIGN PATENT DOCUMENTS

DE 89 15 957 U1 7/1992

(Continued)

OTHER PUBLICATIONS

Derwent Abstract—DE 196 25 043 C1; Apr. 10, 1997; AEG Electrocom GmbH, D-78467 Konstanz, Germany.

(Continued)

*Primary Examiner*—Que T Le
(74) *Attorney, Agent, or Firm*—Laurence A. Greenberg; Werner H. Stemer; Ralph E. Locher

(57) ABSTRACT

An apparatus for detecting overlapping flat objects, wherein each object has flat sides and narrow sides, includes a doubles detector configured to derive at least one feature of an object, a first imaging unit configured to produce an electronic image of a first flat side of the object, and a second imaging unit configured to produce an electronic image of a second flat side of the object. A determination facility of the apparatus is coupled to the first imaging unit and the second imaging unit to receive the electronic images, and to derive at least one further feature of the object. Further, a decision facility of the apparatus is coupled to the doubles detector and the determination facility to receive the least one feature and the at least one further feature of the object, and to determine whether the object is a single object or a number of objects.

6 Claims, 3 Drawing Sheets

U.S. PATENT DOCUMENTS

| | | | | |
|---|---|---|---|---|
| 6,817,610 | B2 | 11/2004 | Rompe | |
| 7,280,797 | B2 * | 10/2007 | Moriyama | 399/382 |
| 2003/0091236 | A1 | 5/2003 | Scicluna et al. | |
| 2005/0105766 | A1 | 5/2005 | Fesquet et al. | |

FOREIGN PATENT DOCUMENTS

| | | | |
|---|---|---|---|
| DE | 196 25 043 | C1 | 4/1997 |
| DE | 102 33 052 | A1 | 2/2004 |
| EP | 0 764 476 | A1 | 3/1997 |
| FR | 2 546 083 | A1 | 11/1984 |
| WO | WO 2006/016186 | A1 | 2/2006 |

OTHER PUBLICATIONS

Derwent Abstract—DE 102 33 052 A1; Feb. 05, 2004; Giesecke & Devrient GmbH, D-81677 Munich, Germany.

Derwent Abstract—FR 2 546 083 A1; Nov. 23, 1984; Hotchkiss-Brandt Sogeme HBS, France.

* cited by examiner

APPARATUS AND METHOD FOR DETECTING OVERLAPPING FLAT OBJECTS WITH A DOUBLES DETECTOR AND ELECTRONIC IMAGES OF FIRST AND SECOND FLAT SIDES OF AN OBJECT

CROSS-REFERENCE TO RELATED APPLICATIONS

The present application is a continuation-in-part of International Application No. PCT/EP2006/007476, filed on Jul. 28, 2006, which designates the U.S. and which claims priority to German Patent Application No. 10 2005 049 558.3, filed on Oct. 12, 2005, both of which are incorporated herein by reference.

BACKGROUND OF THE INVENTION

The invention relates to an apparatus and method for detecting overlapping objects, in particular mail items.

It is known that mail items, in particular letters, can be sorted by machine, wherein individual mail items are withdrawn from stacks of mail items to separate them. To determine whether, for example, two or more mail items have been drawn from the stack instead of a single mail item, a light source of a detector is used to illuminate the underside of the mail item once it has been drawn down and to produce an image of this. The image is used to check whether the mail item has a single edge or a number of edges, in order to decide whether there is a single mail item or a number of, for example, adhering mail items, hereinafter referred to as a double withdrawal, since individual mail items normally only have a single edge.

If a separated mail item has a number of mail items, it is not always an erroneous double withdrawal, but may be, for example, a reply slip to be attached to a mail item. Similarly, a single mail item may have peripheral lines so that the image appears to show a number of edges.

The known separation methods therefore have the disadvantage that it cannot always be reliably decided whether there is a single mail item or a number of mail items, which have been withdrawn from the stack as a double withdrawal.

SUMMARY OF THE INVENTION

There is therefore a need for an apparatus and method, which achieve greater reliability with regard to identifying double withdrawals, when the objects to be separated are drawn from a stack.

Accordingly, one aspect involves an apparatus for detecting overlapping flat objects, wherein each object has flat sides and narrow sides. The apparatus includes a doubles detector configured to derive at least one feature of an object, a first imaging unit configured to produce an electronic image of a first flat side of the object, and a second imaging unit configured to produce an electronic image of a second flat side of the object. A determination facility of the apparatus is coupled to the first imaging unit and the second imaging unit to receive the electronic images, and to derive at least one further feature of the object. Further, a decision facility of the apparatus is coupled to the doubles detector and the determination facility to receive the least one feature and the at least one further feature of the object, and to determine whether the object is a single object or a number of objects.

The apparatus provides for separated objects to be passed between two further imaging units, which respectively produce images of the two flat sides, which are used to derive at least one further object feature, which is supplied additionally to the decision facility to increase the reliability of decisions with regard to the presence of a single object or a double withdrawal. In order therefore to decide whether there is a single object or a double withdrawal with two or more mail items, object features of the flat sides are also used to make the decision, resulting in a significant increase in the reliability of the resulting decision.

The object feature derived using the image of the underside is in one embodiment the number of edges.

It is particularly advantageous if the object features of the flat sides derived using the images from the two further imaging units are the extension in the transport direction, the height, the number of corners of the contour and/or a list of distinguishable objects with defaults in respect of shape and size from a minimum size, such as lines, rectangles, triangles, franking features, their color distribution and position, with these being supplied alone or in combination as a set of object features to the decision facility.

One technically simple realization consists of the decision facility being embodied as a program running in a processor.

It is cost-effective if the imaging units are electronic color cameras in each instance.

Another aspect involves a method of detecting overlapping flat objects, in which at least one feature of an object is derived using a doubles detector. An electronic image of a first flat side of the object is produced using a first imaging unit, and an electronic image of a second flat side of the object is produced using a second imaging unit. At least one further feature of the object is derived using a determination facility configured to process the electronic images. The least one feature and the at least one further feature of the object processed using a decision facility to determine whether the object is a single object or a number of objects.

The method provides for images of the two flat sides to be produced additionally and to be used to derive at least one further object feature, which is used additionally to qualify the decision, in order to increase the reliability of the decision with regard to the presence of a single object or a double withdrawal.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

Figure 1:
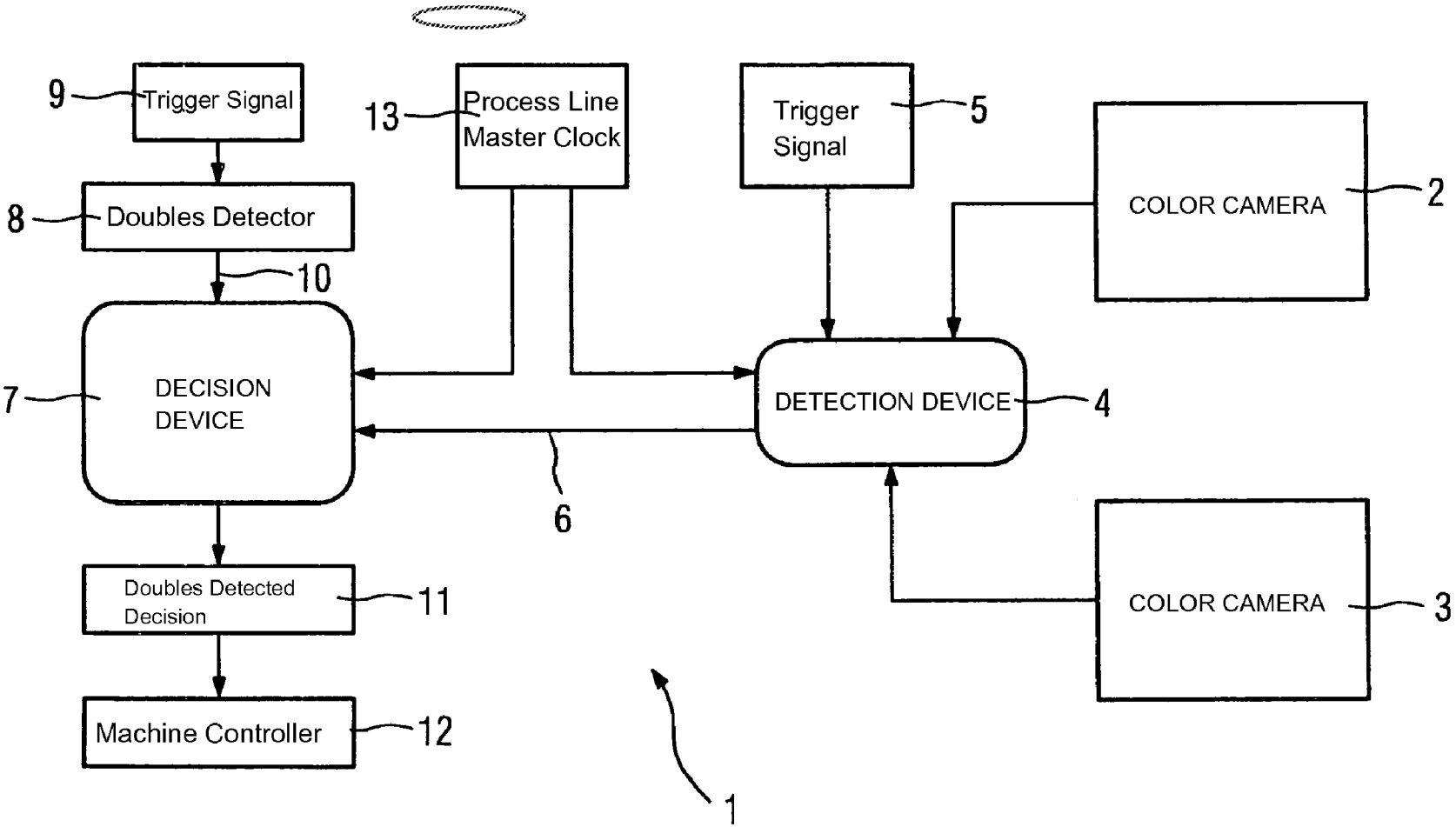
FIG. 1 shows a schematic diagram of a detector for identifying double withdrawals.
Figure 2:
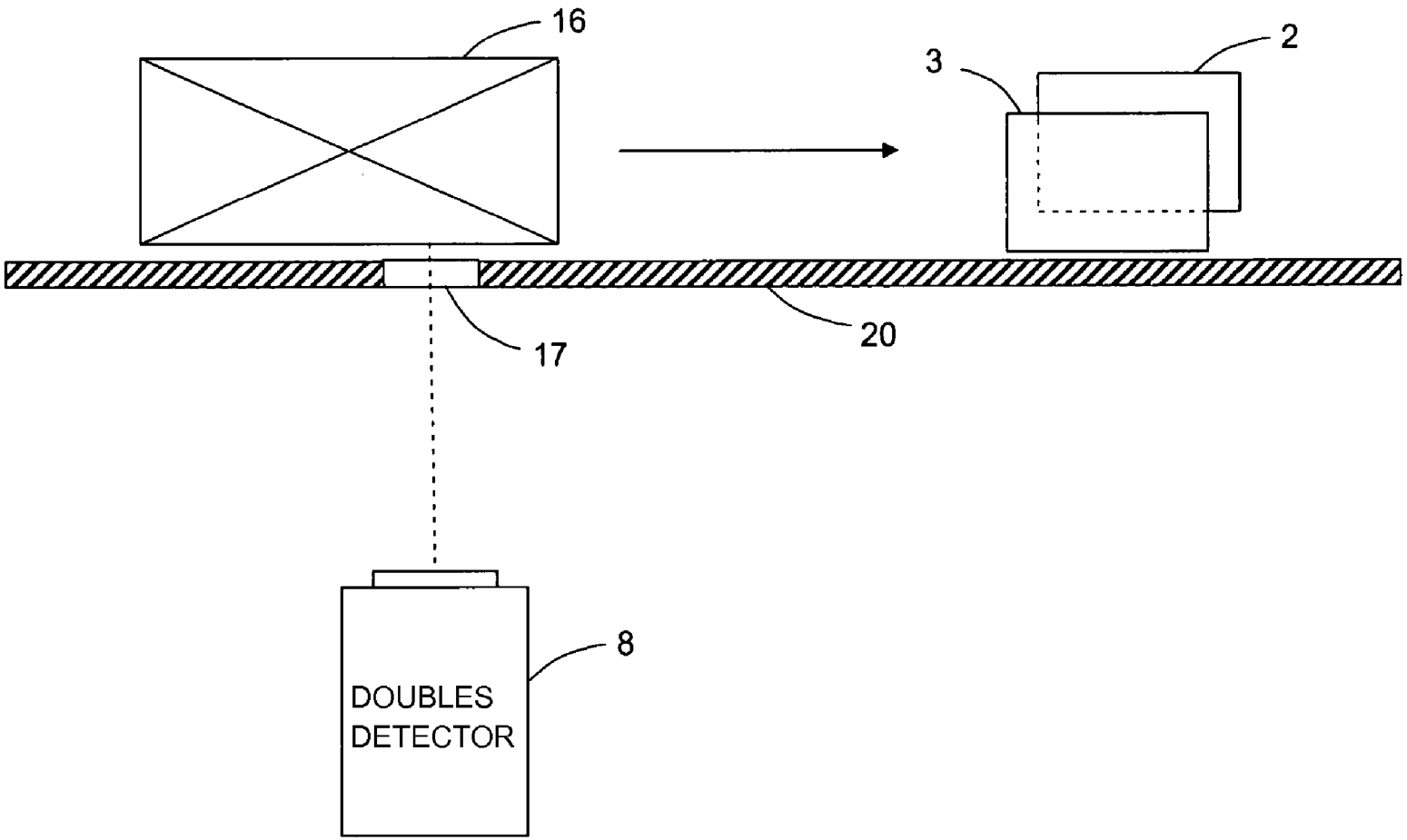
FIG. 2 illustrates an exemplary arrangement of the detector for identifying double withdrawals along a transport path.

FIG. 1 shows a schematic diagram of a detector for double withdrawals in a sorting unit for mail items in the form of specific flat objects, in particular letters, maintained in form of stacks and drawn individually from a stack by means of a separating facility, so that they can then be supplied immediately to a facility for further transportation. FIG. 2 illustrates an exemplary arrangement of the detector for identifying double withdrawals along a transport path.

Referring to FIGS. 1 and 2, the double withdrawal detector 1 is arranged downstream following the separating facility and includes a light source (not shown in more detail), which illuminates the flat sides of a separated mail item 16 transported upright along a transport path 20. The double withdrawal detector 1 includes two color cameras 2, 3 as imaging units to produce electronic images of the two flat sides of the separated mail item 16. As illustrated in FIG. 2, the mail item 16 passes between the two color cameras 2, 3.

A determination facility 4 is coupled to the cameras 2, 3 and serves to define object features processing the electronic images from the two cameras 2, 3. From the electronic images of the object's flat sides the extension in the transport direction, the height, the number of corners of the contour and a list of distinguishable objects with defaults in respect of shape and size from a minimum size, such as lines, rectangles, triangles, franking features, color distribution and position are taken as object features. It is contemplated that further object features can be acquired and determined, as required.

The object features are supplied to a decision facility 7, for example, as a set of object features, as shown by an arrow 6. In one embodiment, the decision facility 7 is configured as processor running a suitable program. A trigger signal 5 serves to synchronize within the determination facility 4 data transmitted by the cameras 2, 3 with the run of mail items.

The decision facility 7 is further coupled to a doubles detector 8 to receive basic object features. As shown in FIG. 2, the doubles detector 8 is positioned below and with its field of vision perpendicular to the path 20 of a stream of separated mail items 16 to be checked for overlapping pieces. A window 17 within the path 20 allows the doubles detector 8 to observe a lower edge of the mail item 16. In one embodiment, the doubles detector 8 is a detector known from and described in U.S. Pat. No. 6,817,610, which is hereby incorporated by reference in its entirety.

The doubles detector 8 is configured to illuminate the lower edge of the mail item 16 and to generate an image of the edge. The image of the edge is used in each instance to determine the number of edges as an object feature of the mail item 16. A trigger signal 9 of the doubles detector 8 serves to synchronize the passing mail items with the acquired object features. Transmission of the object features to the decision facility 7 is shown by an arrow 10 in FIG. 1.

The decision facility 7 processes the respectively determined object features to make a double withdrawal decision 11, specifically whether the separated mail item 16 is a single mail item or a double withdrawal (a number of mail items attached to each other), which have for example continued to adhere to each other in an unwanted manner on withdrawal. For example, it is a single mail item if two edges are determined but one of the two flat sides clearly has the color and shape of a reply card.

Based on the double withdrawal decision 11 a machine controller 12 controls the facility for further transportation of the mail items in such a manner that all mail items that have not been identified as single mail items are ejected. The distance covered by the mail items is determined by the distance clock 13 and allows determination of the position of the mail items within the transport system.

Figure 3:
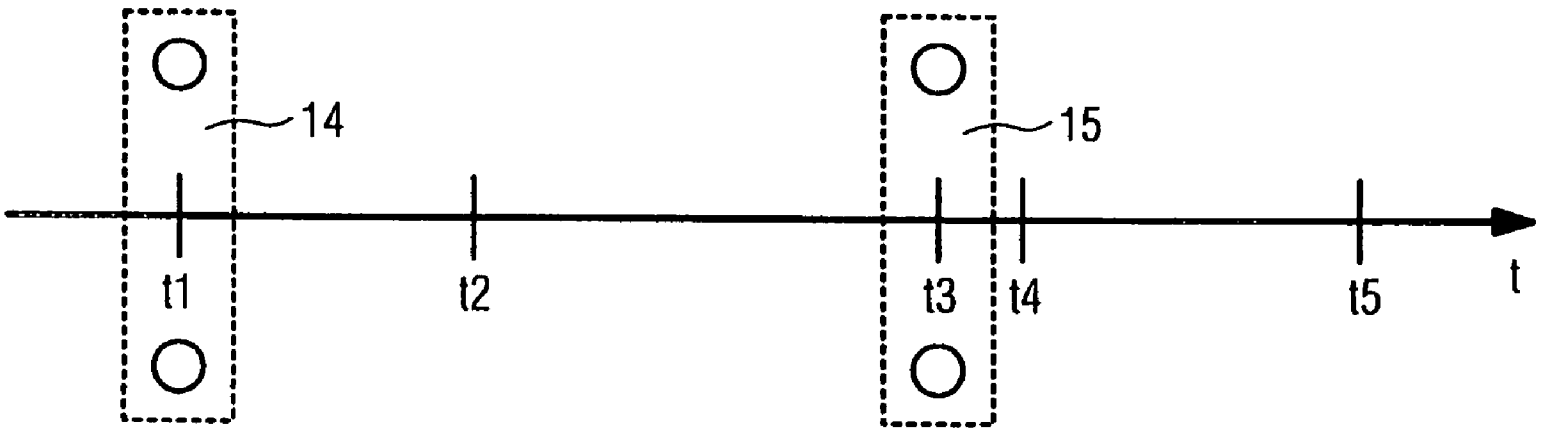
FIG. 3 shows a time schedule for identifying a double withdrawal using its object features.

FIG. 3 shows a schematic diagram of the temporal profile of the acquisition of object features during transportation of the mail items. FIG. 3 therefore shows the start t1 of scanning of the flat sides of the mail items, as controlled by the trigger facility 14. At time t2 the object features of this mail item are determined and therefore available. At time t3 the mail item reaches the doubles detector light barrier 15, which controls the scanning of the lower edges in the doubles detector 8. At time t4, when the features of the lower edges (e.g. their number) are already available as their object features, the object features of the flat sides are supplied to the decision facility 7 and at time t5 the result is available to the decision facility 7 as the double withdrawal decision 11. Of course the arrangement of the two components can also be changed, resulting in a correspondingly different time sequence.

What is claimed is:

1. An apparatus for detecting overlapping flat objects, each object having flat sides and narrow sides, comprising:

a doubles detector configured to derive at least one feature of an object;

a first imaging unit configured to produce an electronic image of a first flat side of the object;

a second imaging unit configured to produce an electronic image of a second flat side of the object;

a determination facility coupled to the first imaging unit and the second imaging unit to receive the electronic images, and to derive at least one further feature of the object; and a decision facility coupled to the doubles detector and the determination facility to receive the least one feature and the at least one further feature of the object, and to determine whether the object is a single object or a number of objects.

2. The apparatus of claim 1, wherein the at least one object feature derived by the doubles detector is the number of edges.

3. The apparatus of claim 1, wherein the at least one further feature derived by the determination facility is at least one of an extension in transport direction, a height, a number of corners of a contour and a list of distinguishable objects with defaults in respect of shape and size from a minimum size.

4. The apparatus of claim 1, wherein the decision facility is embodied as a program running in a processor.

5. The apparatus of claim 1, wherein the imaging units are electronic color cameras.

6. A method of detecting overlapping flat objects, comprising:

deriving at least one feature of an object using a doubles detector;

producing an electronic image of a first flat side of the object using a first imaging unit;

producing an electronic image of a second flat side of the object using a second imaging unit;

deriving at least one further feature of the object using a determination facility configured to process the electronic images; and processing the least one feature and the at least one further feature of the object using a decision facility to determine whether the object is a single object or a number of objects.

* * * * *